United States Patent [19]

Baroï

[11] Patent Number: 5,007,551

[45] Date of Patent: Apr. 16, 1991

[54] RECEPTACLES DESIGNED TO ENABLE THEIR JUXTAPOSITION

[76] Inventor: Stefan Baroï, 40, Chemin de la Chevillarde, 1208 Geneva, Switzerland

[21] Appl. No.: 278,941

[22] PCT Filed: Feb. 8, 1988

[86] PCT No.: PCT/CH88/00030

§ 371 Date: Sep. 27, 1988

§ 102(e) Date: Sep. 27, 1988

[87] PCT Pub. No.: WO88/06132

PCT Pub. Date: Aug. 25, 1988

[30] Foreign Application Priority Data

Feb. 12, 1987 [FR] France ..... 87 02176

[51] Int. Cl.[5] ..... B65D 21/02

[52] U.S. Cl. ..... 220/23.4; 215/10

[58] Field of Search ..... 220/23.4, 23.83; 215/10

[56] References Cited

U.S. PATENT DOCUMENTS

| | | | |
|---|---|---|---|
| 2,641,374 | 6/1953 | Der Yuen | 215/10 |
| 3,217,915 | 11/1965 | Weygandt | 215/10 |
| 3,369,688 | 2/1968 | Dike | 215/10 |
| 3,374,917 | 3/1968 | Troy | 215/10 X |
| 4,386,701 | 6/1983 | Galer | 215/10 X |
| 4,570,799 | 2/1986 | Mednis | 220/23.4 X |
| 4,640,423 | 2/1987 | Mednis | 220/23.4 X |
| 4,656,840 | 4/1987 | Loofbourrow et al. | 215/10 X |

*Primary Examiner*—Steven M. Pollard

*Attorney, Agent, or Firm*—Kane, Dalsimer, Sullivan, Kurucz, Levy, Eisele and Richard

[57] ABSTRACT

Receptacles designed to enable their juxtaposition and/or superposition without loss of space and without the addition of external packaging, enabling the reception of a large number of everyday contents. Said receptacles each consist of a hollow modular cell, comprising at least one neck and one hollow into which an identical neck fits. Preferably said receptacles are composed of interconnectable cubic modular cells. Three consecutive faces of the cube are each provided with a neck, the three other consecutive faces being each provided with an identical hollow. Each neck and each hollow is provided with engaging complementary groove and ribs, brought into action by the insertion of the neck of a receptacle into the hollow in the juxtaposed receptacle.

16 Claims, 4 Drawing Sheets

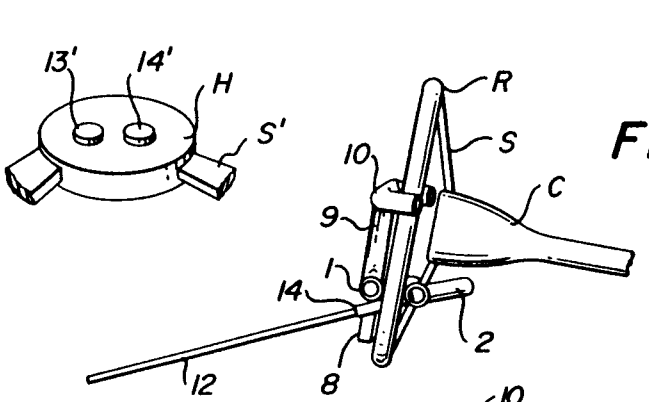
FIG. 3
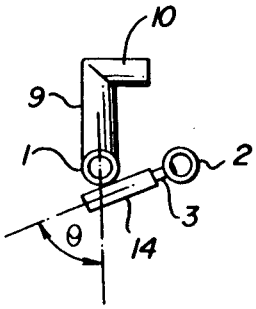
FIG. 2
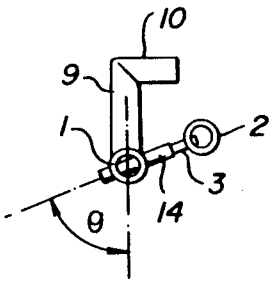
FIG. 4
FIG. 5
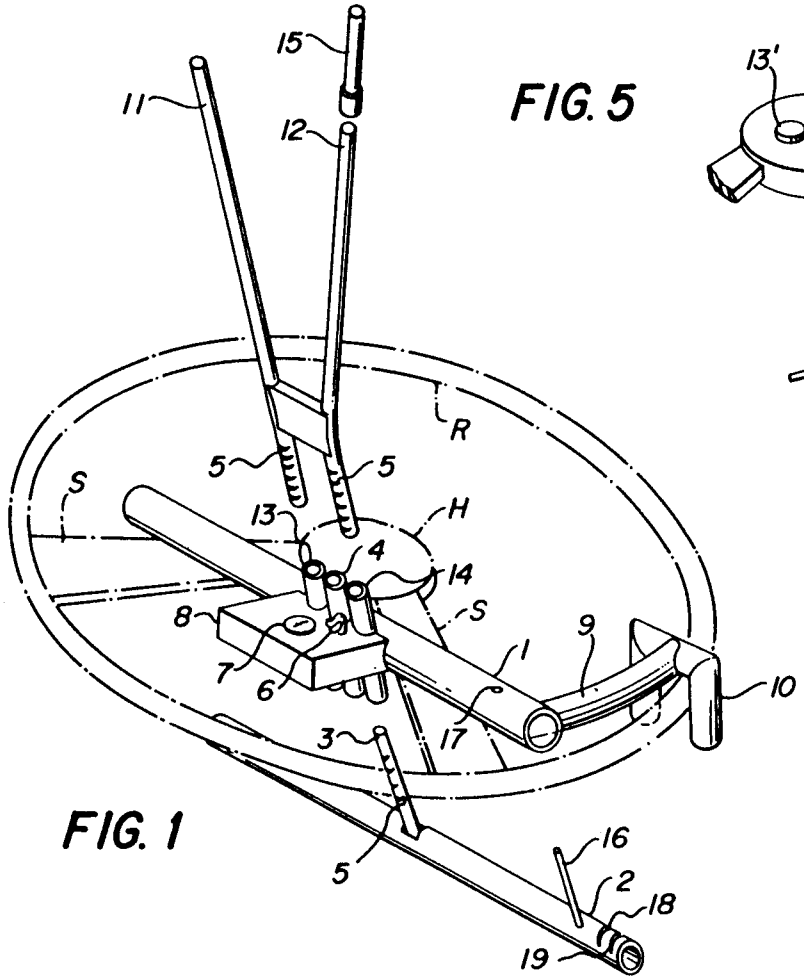
FIG. 1

2
21
10
2''
2'
30
3
3'
3''
1
t
Y
X
a
p
h
h'
45°

45°
X
Y
1
2
2'
2''
3
3'
3''
10
21
30
a
p
h
h'
t

RECEPTACLES DESIGNED TO ENABLE THEIR JUXTAPOSITION

The invention relates to receptacles, packaging elements or packs for contents having special problems of storage or transport or designed to serve purposes other than packaging after being emptied of their content, specifically containers produced from a plastic suitable for the product to be packaged.

These containers serve for packaging food liquids, such as water, fruit juices, milk and derivatives or by-products of milk, semi-liquid products, such as creams, food powders or other powders (detergents).

In this sector, the prior art is described by the documents summarized below.

The document FR-A-2,063,175 describes a spherical bottle carrying cylindrical cells of a size identical to that of the stopper. The stopper of another similar bottle can be introduced and secured in one of these cells. The assemblies formed by these bottles can be made more complex by the use of spacers of the same diameter as the stoppers and of double length.

To assemble these bottles, it is necessary to use an accessory piece.

The document FR-A-2,574,757 describes a modular plastic bottle characterized by the assembly of successive modules, the said modules being joined to form a single assembly.

These bottles are assembled by screwing in an exclusively linear manner.

The document FR-A-2,276,236 describes packs, containers or pots convertible into toy elements, characterized in that they consist of hollow parallelepipeds which can be assembled together on at least three faces, each assembly being obtained as a result of the engagement of a male outer projection formed on one face of a parallelepiped into an outward-facing female recess formed on one face of another parallelepiped.

The assembly of these containers does not have any means for retaining the packs to one another.

The document DE-A-2,115,693 describes containers, characterized in that an assembly of two or more containers is made possible by the presence of corresponding reliefs and cavities on their faces.

The assembly of these containers does not have means for retaining the packs with one another other than the friction of the reliefs in the corresponding cavities.

The object of the invention is, in particular, to provide containers, the form of which allows a juxtaposition and/or superposition, without loss of space and without the addition of an outer packaging or a grouping wrapper, in order to provide a plurality of conventional capacities.

To achieve this, these containers each consist of a hollow modular cell comprising at least one neck and at least one recess serving as a receptacle for an identical neck of another cell, each modular cell being connectable to at least one other modular cell, the assembly being held together by snapping means activated as a result of the engagement of a neck of one cell into a recess of the juxtaposed cell.

In one embodiment, the modular cell is spherical.

In another embodiment, each modular cell is a hollow rectangular parallelepiped, at least one side of which is equipped with a circular neck concentric with the geometrical center of the side supporting this neck. At least one other side of the rectangular parallelepiped has a circular recess concentric with the geometrical center of the side equipped with the recess. The inside diameter of the recess is at least equal to the outside diameter of the neck.

In a preferred embodiment, the modular cells are cubic, and three consecutive faces of the cube are each equipped with an identical neck, the other three consecutive faces each being equipped with an identical recess, the outer dimensions of the necks corresponding to the inner dimensions of the recesses.

The main advantage of these containers is that, when a neck of one of the containers is placed in a recess of another identical container, the packaged-product capacity is doubled, the volume occupied by the containers so assembled being scarcely larger than the volume of product accommodated in these containers.

Other advantages will emerge from the description of preferred embodiments, given by way of non-limiting example, and from the drawing in which.

Figures 5, 5A, 5B, 6, 6A, 6B:
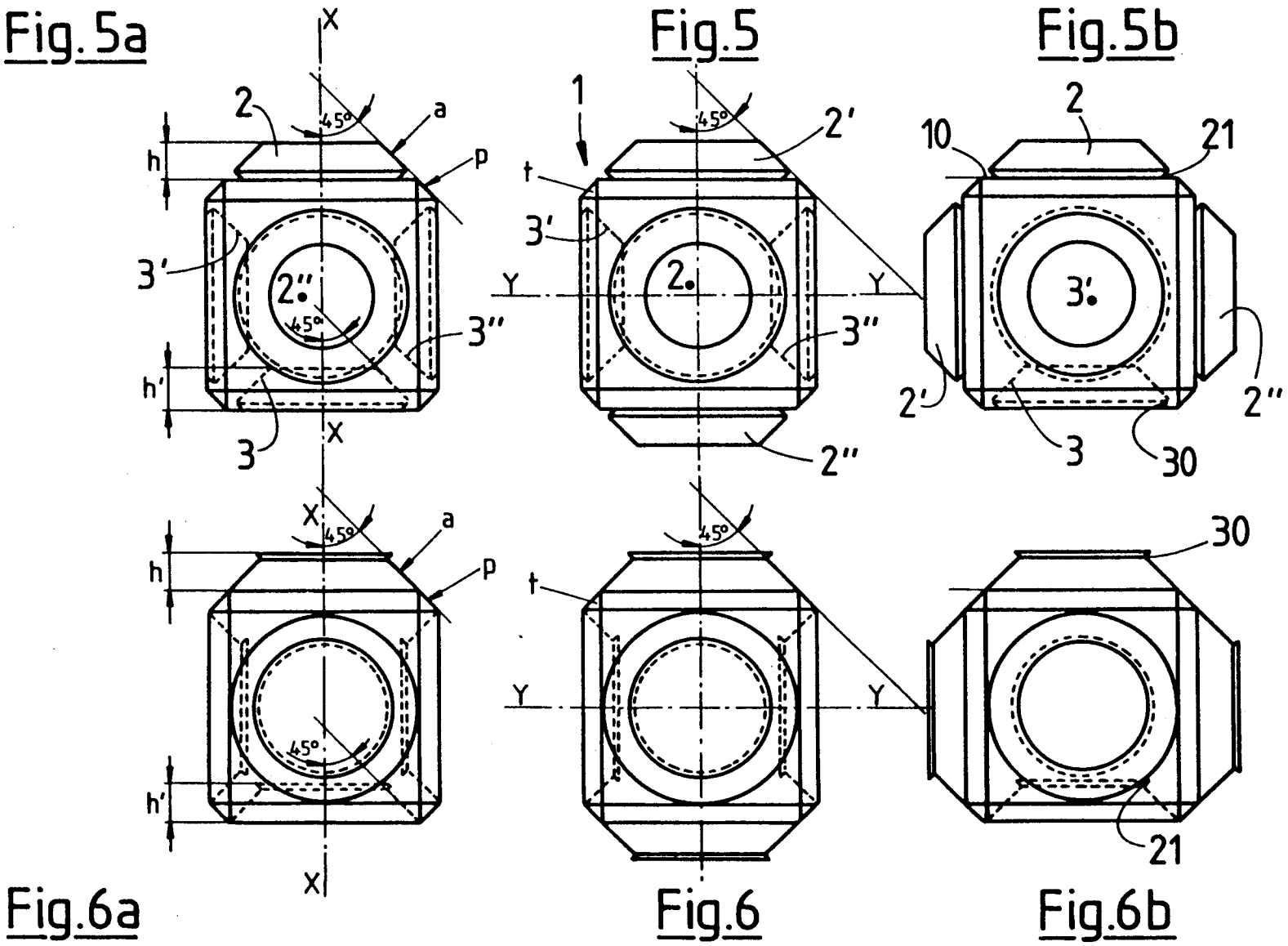
Figures 7, 7A, 7B, 8, 8A, 8B:
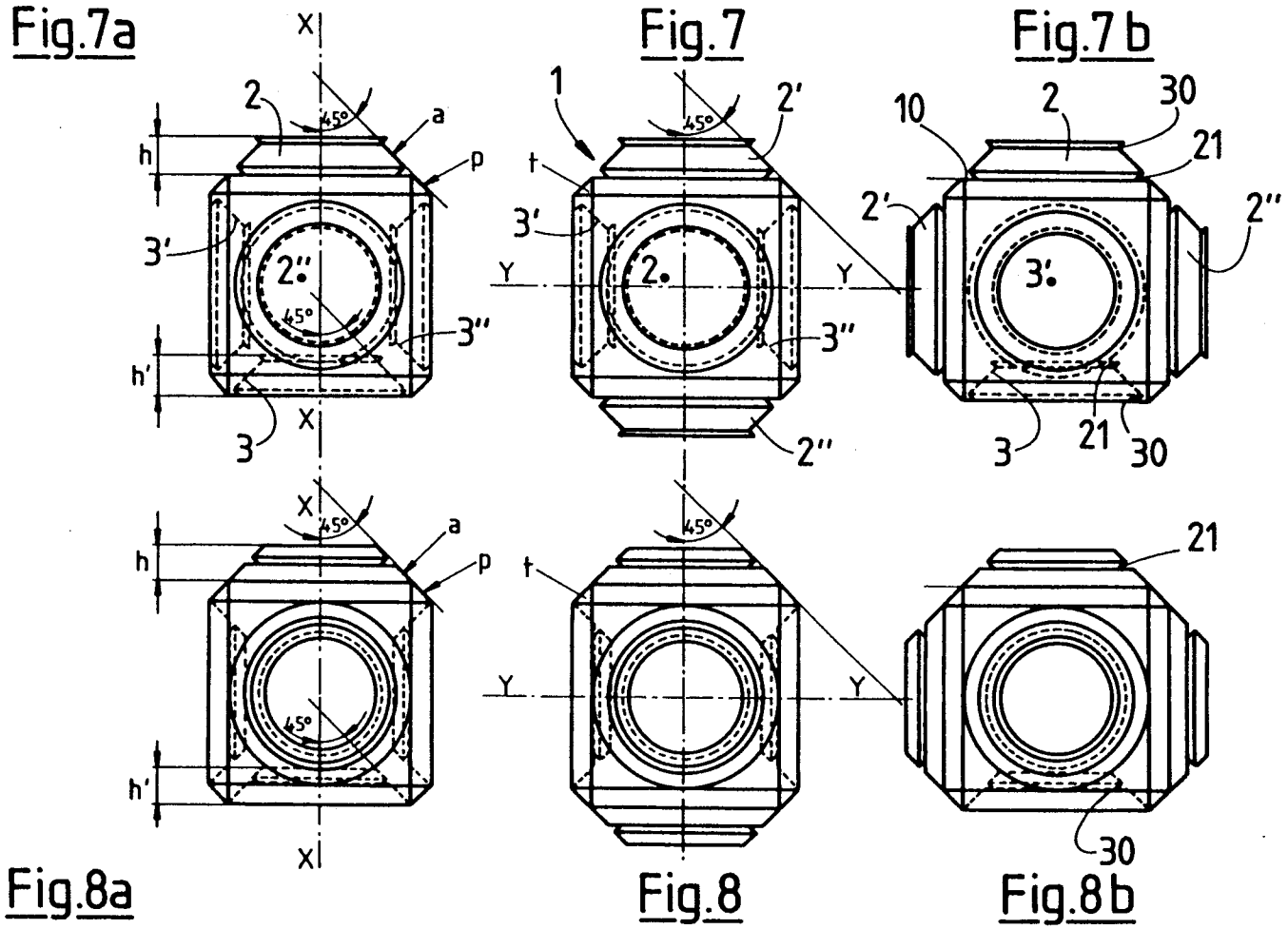

FIGS. 5, 5*a* and 5*b* are views of another form of containers with frustoconical necks and recesses equipped with snapping ribs and grooves adjacent to the joining faces of the containers, FIGS. 6, 6*a* and 6*b* show an alternative version of the containers of FIG. 5, in which the rib is located at the top of the neck and the groove is located in the bottom of the recess, FIGS. 7, 7*a* and 7*b* show an alternative form of the containers of FIGS. 5 and 6, in which each neck or each recess is equipped both with a corresponding groove and with a corresponding recess, FIGS. 8, 8*a* and 8*b* show an alternative form of the containers of FIG. 5, in which the rib and the groove are located alternately on a neck or in a recess at a corresponding distance from the bottom of the recess and/or from the top of the neck.

Figure 1:
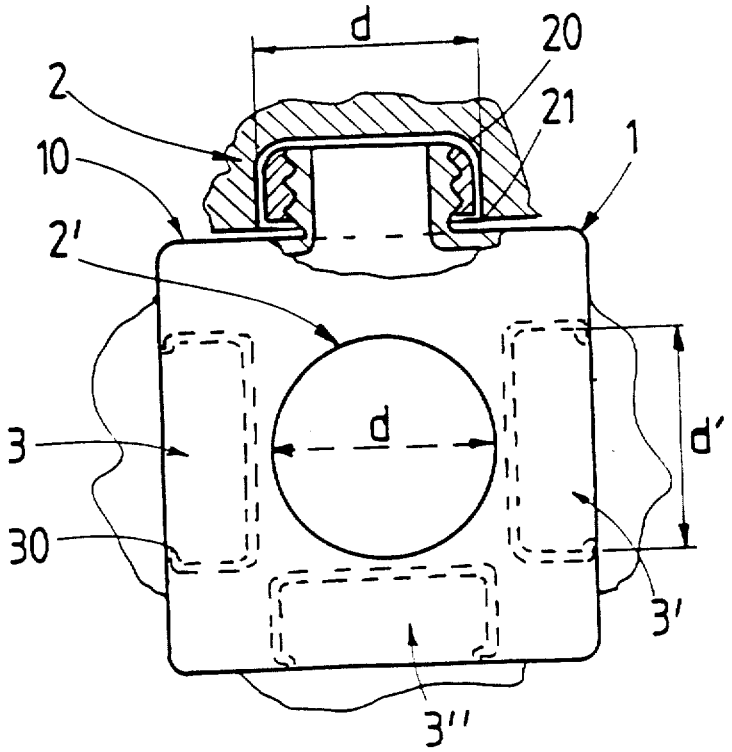
FIG. 1 is a view of a container according to one embodiment.

The container illustrated in FIG. 1 is a hollow cube 1 having a neck 2, 2', 2'' on each of the three consecutive faces and a recess 3, 3', 3'' on each of the other three faces. The height (h) of the necks is equal to the depth (h') of the recesses.

The necks 2, 2', 2'' are circular and concentric with the geometrical center of the side supporting each neck.

The recesses 3, 3', 3'' are likewise circular and concentric with the geometrical center of the side supporting each recess.

Figure 4:
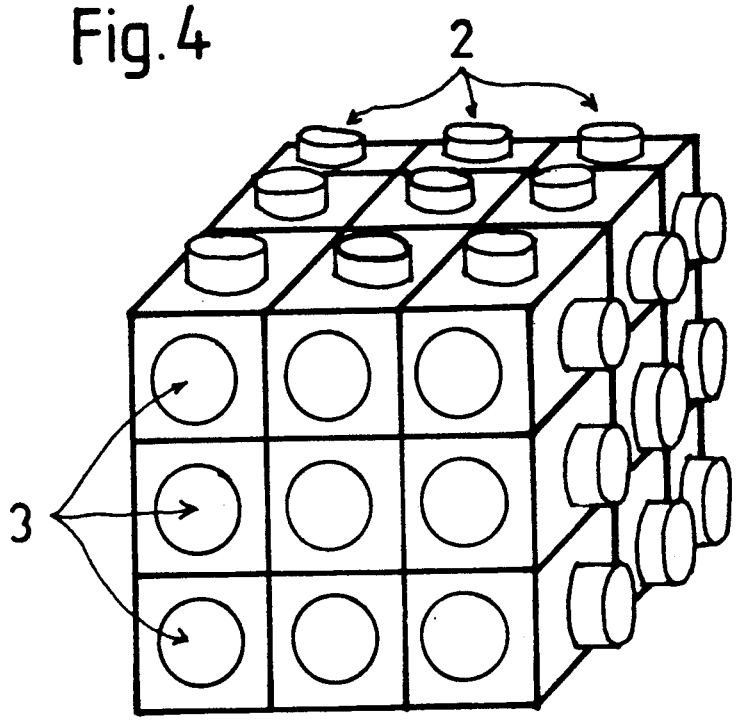
FIG. 4 is a perspective view of grouped containers.
Figure 3:
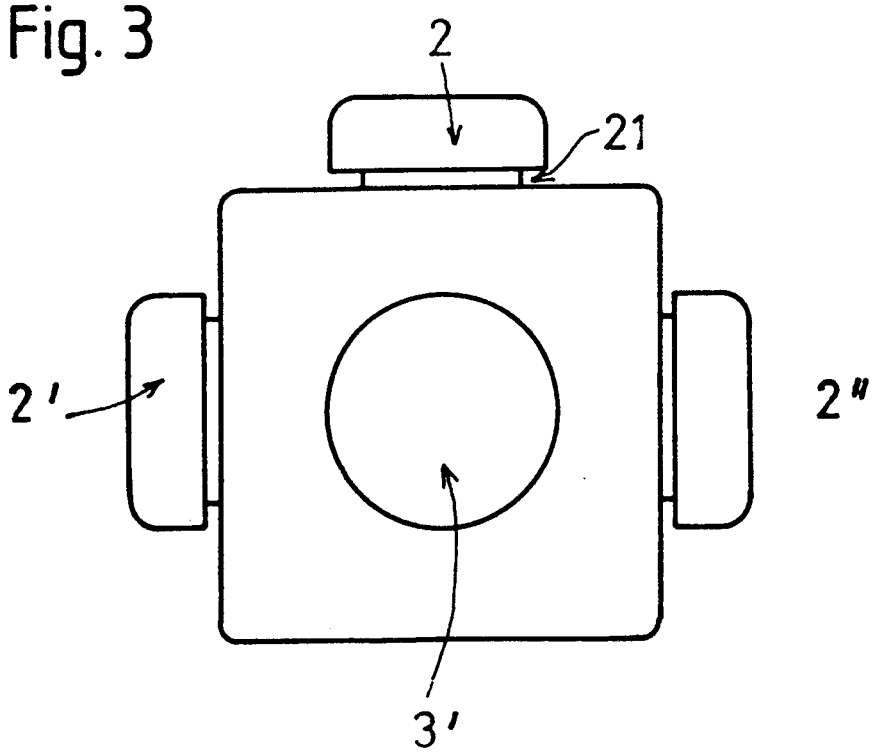
FIG. 3 is a front view of a container according to FIG. 1.
Figure 2:
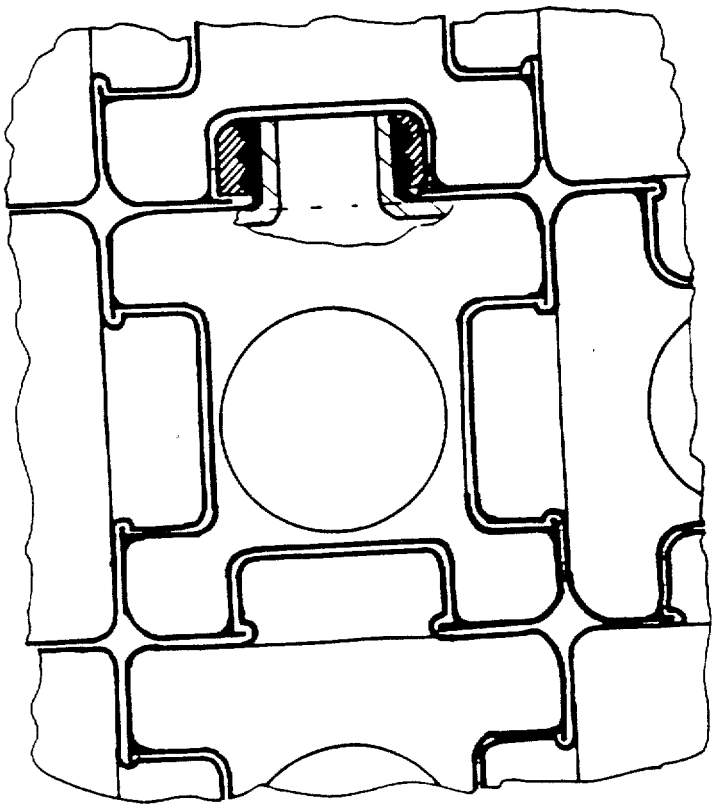
FIG. 2 is a diagrammatic view of grouped containers.

The outside diameter (d) of the necks 2, 2', 2'' corresponds to the inside diameter (d') of the recesses 3, 3', 3'', so that any one of the necks 2, 2', 2'' can be placed in any one of the recesses 3, 3', 3'' during a grouping of the containers, as indicated in FIGS. 2 and 4.

Any one of the necks 2, 2', 2'' and/or any one of the recesses 3, 3', 3'' can serve as a filling orifice closed by a known means, stopper, cap, etc.

The removable fastening of at least two juxtaposable containers, one having at least one neck 2, 2', 2'' and the other having at least one corresponding recess 3, 3', 3'', is made effective by snapping means.

The snapping means consist of the presence on the neck 2, 2', 2'', alternatively in the recess 3, 3', 3'', of at least one circular groove 21 and of the presence in the recess, alternatively on the neck, of at least one circular rib 30, the cross-section and position of the rib corresponding to the cross-section of the position of the groove.

These snapping means are activated by exerting a slight pressure to bring the containers together after a neck of one has been placed in a recess of the other.

This snapping is reversible, the separation of two or more assembled containers being made easier as a result of the elasticity of the plastic used for producing these containers.

In the embodiment illustrated in FIG. 1, the middle neck 2 has a closure formed by a screwed cover 20.

The cover 20 is equipped with a groove 21 near its base; when it is screwed in order to close the neck 2, this groove 21 becomes tangential to the face 10 supporting the neck 2.

The outside diameter (d) of the cover 20 is at most equal to the inside diameter (d') of any one of the recesses 3, 3', 3''.

The other two necks 2', 2'' likewise have, tangentially to their base, a groove 21 identical to the groove of the cover 20.

Each recess 3, 3', 3'' has a circular rib 30 arranged tangentially to the outer face of the container, so that it assumes position in the groove 21 of the corresponding neck 2, 2', 2'', when one or more containers are juxtaposed as a result of the introduction of a neck 2, 2', 2'' into a recess 3, 3', 3''.

The position and cross-section of each circular groove 21 correspond to the position and cross-section of any one of the ribs 30.

The circular groove 21 and/or the circular rib 30 can be continuous or discontinuous.

The means of rapid assembly of the modular cells face to face make it possible to produce compact forms giving the best possible weight/volume ratio for the transport and/or storage of the containers (FIG. 4).

These modular cells also form elements which can be assembled in different ways, in order to produce varied advertising, decorative or entertaining structures.

FIGS. 5, 5*a* and 5*b* illustrate an embodiment imparting greater efficiency to the snapping means consisting of the rib 30 located on the periphery of the recess 3, 3', 3'' and interacting with the groove 21 likewise located on the periphery of the neck of the container.

The rib 30 and the groove 21 are circular, continuous or discontinuous, of corresponding cross-sections and both adjacent to the outer face 10 supporting the neck or the recess, so that the snapping of two containers lays these faces against one another.

The necks 2, 2', 2'' and the recesses 3, 3', 3'' are inscribed in a cone, the generatrix (a) of which forms an angle of 45° with the axes of symmetry XX, YY with which they are concentric.

The height h of the truncated cone of the necks 2, 2', 2'' is equal to the height h' of the recesses 3, 3', 3''.

The faces 10 of each container are joined by means of a bevel (p).

A generatrix (a) of each neck 2, 2', 2'' is inscribed in the plane of each bevel (p), the said plane likewise forming an angle of 45° with the axes of symmetry XX, YY.

These characteristics give the containers so formed a greater rigidity.

The thrustoconical form of the necks and of the recesses affords a considerable advantage in terms of the production of these containers by compression molding.

This thrustoconical form makes it easier to insert a neck 2, 2', 2'' into a recess 3, 3', 3'' until a rib 30 coincides with a groove 21: a click occurs when the containers are effectively secured against one another.

FIGS. 6, 6*a* and 6*b* show an alternative version of the preceding embodiment:

The snapping means, namely the groove 21 and the rib 30, have a reverse position in the necks and the thrustoconical recesses.

The rib 30 is carried annularly on the top of the neck 2, 2', 2'', and the snapping groove 21 is located in the bottom of the recess 3, 3', 3''.

The coupling of one container to another becomes effective when the outer faces 10 meet under the effect of the pressure which introduces the rib 30 into the groove 21.

The embodiment illustrated in FIGS. 7, 7*a* and 7*b* has double snapping: each neck 2, 2', 2'' and each recess 3, 3', 3'' have both a rib 30 and a groove 21 which are respectively located one at the base and the other at the top, or vice versa, so that a groove corresponds to each rib.

The embodiment illustrated in FIGS. 8, 8*a* and 8*b* has simple snapping consisting of a single rib 30 and a single groove 21 which are respectively located on a neck 2, 2', 2'' and in a recess 3, 3', 3'' at a height of their wall which ensures exact coincidence at the moment of snapping.

I claim:

1. Juxtaposable containers, each consisting of a hollow modular cell comprising at least one neck and at least one recess serving as a receptacle for an identical neck of another cell, each modular cell being connectable to at least one other modular cell, wherein each neck and each recess are equipped with matching snapping means, and wherein these means are activated as a result of the engagement of a neck of one cell into a recess of the juxtaposed cell, wherein the modular cells are cubic, wherein at least one face is equipped with a neck (2, 2', 2''), and wherein at least one other face is equipped with a recess (3, 3', 3''), the outer dimensions of the necks corresponding to the inner dimensions of the recesses, and the necks and recesses being concentric with the geometrical center of the faces of the cube which are equipped with them, wherein the neck (2, 2', 2'') and the recesses (3, 3', 3'') are truncated cones, and wherein the height (h) of the necks is identical to the depth (h') of the recesses, wherein the generatrix (a) of the cone in which the necks (2, 2', 2'') and the recesses (3, 3', 3'') are inscribed forms an angle of 45° with the axis of symmetry (XX, YY) with which they are concentric, wherein the faces (10) of each container are joined by means of a bevel (p), and wherein a generatrix (a) of each neck (2, 2', 2'') is inscribed in the geometrical plane of each bevel.

2. Containers as claimed in claim 1, wherein the snapping means consist of the presence on each neck (2, 2', 2''), alternatively in each recess (3, 3', 3''), of at least one circular groove (21) and of the presence in each recess, alternatively on each matching neck, of at least one circular rib (30), the cross-section and position of the rib corresponding to the cross-section and position of the groove, the rib and the groove respectively being continuous or discontinuous.

3. Containers as claimed in claim 2, wherein each recess (3, 3', 3'') is equipped with an inner circular rib (30) adjacent to the face of the side supporting the recess, and wherein each neck (2, 2', 2'') is equipped at its base with a circular groove (21) adjacent to the face of the side supporting the neck.

4. Containers as claimed in claim 2, wherein the rib (30) is carried annularly on the top of each neck (2, 2', 2''), and wherein the groove (21) is located in the bottom of each recess (3, 3', 3'').

5. Containers as claimed in claim 2, wherein the rib (30) is located in the bottom of each recess (3, 3', 3'') and the groove (21) is located at the top of each neck (2, 2', 2'').

6. Containers as claimed in claim 2, which have double snapping consisting of the presence on each neck (2, 2', 2'') and in each recess (3, 3', 3'') both of a rib (20) and of a groove (21) which are respectively located one at the base and the other at the top, or vice versa, so that a groove corresponds to each rib.

7. Containers as claimed in claim 2, which have simple snapping consisting of a single rib (30) and a single groove (21) which are located respectively on each neck (2, 2', 2'') and in each recess (3, 3', 3'') at the height of their wall which ensures an exact coincidence for assembling them.

8. Containers as claimed in claim 2, wherein the rib (30) is located in the bottom of each recess (3, 3', 3'') and the groove (21) is located at the top of each neck (2, 2', 2'').

9. Containers as claimed in claim 2, which have double snapping consisting of the presence on each neck (2, 2', 2'') and in each recess (3, 3', 3'') both of a rib (20) and of a groove (21) which are respectively located one at the base and the other at the top, or vice versa, so that a groove corresponds to each rib.

10. Containers as claimed in claim 1, wherein any one of the necks (2, 2', 2'') and/or any one of the recesses (3, 3', 3'') can serve as a filling orifice closed by a known means, stopper, cap, etc.

11. Juxtaposable containers, each consisting of a hollow modular cell comprising at least one neck and at least one recess, wherein the neck and the recess are truncated cones and the height of the necks is identical to the depth of the recesses, serving as a receptacle for an identical neck of another cell, each modular cell being connectable to at least one other modular cell, wherein each neck and each recess are equipped with matching snapping means, and wherein these means are activated as a result of the engagement of a neck of one cell into a recess of the juxtaposed cell and wherein the generatrix of the cone in which the necks and the recesses are inscribed forms an angle of 45° with the axis of symmetry with which they are concentric, and wherein the faces of each container are joined by means of a bevel, and wherein the generatrix of the cones is inscribed in the geometrical plane of each.

12. Containers as claimed in claim 11, wherein any one of the necks (2, 2', 2'') and/or any one of the recesses (3, 3', 3'') can serve as a filling orifice closed by a known means, stopper, cap, etc.

13. Containers as claimed in claim 11, wherein the snapping means consist of the presence of each neck (2, 2', 2''), alternatively in each recess (3, 3', 3''), of at least one circular groove (21) and of the presence in each recess, alternatively on each matching neck, of at least one circular rib (30), the cross-section and position of the rib corresponding to the cross-section and position of the groove, the rib and the groove respectively being continuous or discontinuous.

14. Containers as claimed in claim 13, wherein each recess (3, 3', 3'') is equipped with an inner circular rib (30) adjacent to the face of the side supporting the recess, and wherein each neck (2, 2', 2'') is equipped at its base with a circular groove (21) adjacent to the face of the side supporting the neck.

15. Containers as claimed in claim 13, wherein the rib (30) is carried annularly on the top of each neck (2, 2', 2''), and wherein the groove (21) is located in the bottom of each recess (3, 3', 3'').

16. Containers as claimed in claim 13, which have simple snapping consisting of a single rib (30) and a single groove (21) which are located respectively on each neck (2, 2', 2'') and in each recess (3, 3', 3'') at the height of their wall which ensures an exact coincidence for assembling them.

* * * * *

UNITED STATES PATENT AND TRADEMARK OFFICE

CERTIFICATE OF CORRECTION

PATENT NO. : 5,007,551

DATED : April 16, 1991

INVENTOR(S) : Stefan Baroi

It is certified that error appears in the above-indentified patent and that said Letters Patent is hereby corrected as shown below:

The title page showing the illustrative figure should be deleted to be replaced with the attached title page.

Sheet 1 of the drawings, consisting of Figs. 1-5, should be deleted to be replaced with the sheet of drawings consisting of Figs. 1-2, as shown on the attached pages.

Signed and Sealed this

Twenty-eighth Day of September, 1993

Bruce Lehman

*Attest:*

BRUCE LEHMAN

*Attesting Officer*

*Commissioner of Patents and Trademarks*

United States Patent [19]

Baroï

[11] Patent Number: 5,007,551

[45] Date of Patent: Apr. 16, 1991

[54] RECEPTACLES DESIGNED TO ENABLE THEIR JUXTAPOSITION

[76] Inventor: Stefan Baroï, 40, Chemin de la Chevillarde, 1208 Geneva, Switzerland

[21] Appl. No.: 278,941

[22] PCT Filed: Feb. 8, 1988

[86] PCT No.: PCT/CH88/00030

§ 371 Date: Sep. 27, 1988

§ 102(e) Date: Sep. 27, 1988

[87] PCT Pub. No.: WO88/06132

PCT Pub. Date: Aug. 25, 1988

[30] Foreign Application Priority Data

Feb. 12, 1987 [FR] France ..... 87 02176

[51] Int. Cl.[5] ..... B65D 21/02

[52] U.S. Cl. ..... 220/23.4; 215/10

[58] Field of Search ..... 220/23.4, 23.83; 215/10

[56] References Cited

U.S. PATENT DOCUMENTS

| | | | |
|---|---|---|---|
| 2,641,374 | 6/1953 | Der Yuen | 215/10 |
| 3,217,915 | 11/1965 | Weygandt | 215/10 |
| 3,369,688 | 2/1968 | Dike | 215/10 |
| 3,374,917 | 3/1968 | Troy | 215/10 X |
| 4,386,701 | 6/1983 | Galer | 215/10 X |
| 4,570,799 | 2/1986 | Mednis | 220/23.4 X |
| 4,640,423 | 2/1987 | Mednis | 220/23.4 X |
| 4,656,840 | 4/1987 | Loofbourrow et al. | 215/10 X |

*Primary Examiner*—Steven M. Pollard

*Attorney, Agent, or Firm*—Kane, Dalsimer, Sullivan, Kurucz, Levy, Eisele and Richard

[57] ABSTRACT

Receptacles designed to enable their juxtaposition and/or superposition without loss of space and without the addition of external packaging, enabling the reception of a large number of everyday contents. Said receptacles each consist of a hollow modular cell, comprising at least one neck and one hollow into which an identical neck fits. Preferably said receptacles are composed of interconnectable cubic modular cells. Three consecutive faces of the cube are each provided with a neck, the three other consecutive faces being each provided with an identical hollow. Each neck and each hollow is provided with engaging complementary groove and ribs, brought into action by the insertion of the neck of a receptacle into the hollow in the juxtaposed receptacle.

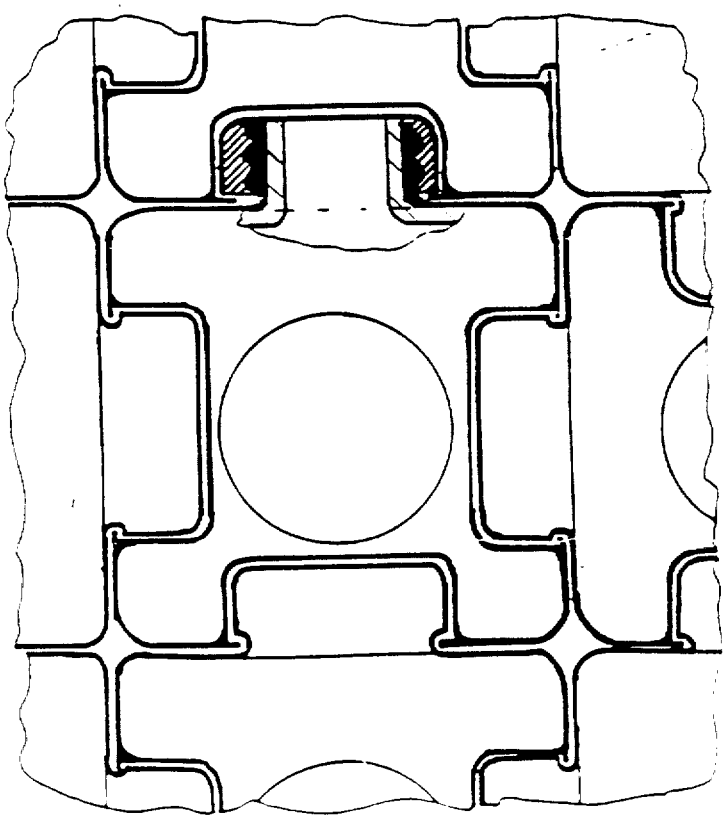

16 Claims, 4 Drawing Sheets